US008813315B2

(12) United States Patent
Schultz

(10) Patent No.: US 8,813,315 B2
(45) Date of Patent: Aug. 26, 2014

(54) BELT BUCKLE

(76) Inventor: Bryan Schultz, Kenosha, WI (US)

( * ) Notice: Subject to any disclaimer, the term of this patent is extended or adjusted under 35 U.S.C. 154(b) by 149 days.

(21) Appl. No.: 13/465,437

(22) Filed: May 7, 2012

(65) Prior Publication Data

US 2012/0222270 A1 Sep. 6, 2012

Related U.S. Application Data

(63) Continuation-in-part of application No. 12/338,208, filed on Dec. 18, 2008, now Pat. No. 8,171,605.

(60) Provisional application No. 61/014,558, filed on Dec. 18, 2007.

(51) Int. Cl.
*A44B 11/00* (2006.01)

(52) U.S. Cl.
USPC ..... 24/163 R; 24/302; 24/662; 24/303

(58) Field of Classification Search
USPC ..... 24/302, 303, 649, 639, 640, 650, 590.1, 24/595.1, 265 BC, 652, 653, 662, 633; 84/327
See application file for complete search history.

(56) References Cited

U.S. PATENT DOCUMENTS

| | | | | |
|---|---|---|---|---|
| 2,833,015 | A | 5/1958 | Kreisler | |
| 4,642,855 | A | 2/1987 | Densmore | |
| 4,901,900 | A | 2/1990 | Goto | |
| 5,199,138 | A * | 4/1993 | Morita | 24/303 |
| 5,253,394 | A * | 10/1993 | Morita | 24/303 |
| 5,377,392 | A * | 1/1995 | Morita | 24/303 |
| 5,572,772 | A * | 11/1996 | Morita | 24/303 |
| 5,673,463 | A | 10/1997 | Chih-Wen | |
| 5,868,445 | A * | 2/1999 | Kaufman et al. | 292/251.5 |
| 5,937,487 | A * | 8/1999 | Bauer | 24/303 |
| 6,032,339 | A | 3/2000 | D'Addario | |
| 6,065,367 | A | 5/2000 | Schroth | |
| 6,295,702 | B1 * | 10/2001 | Bauer | 24/303 |
| 6,324,733 | B1 | 12/2001 | Brown | |
| 6,687,963 | B1 | 2/2004 | Chang | |
| 7,045,694 | B2 | 5/2006 | Yasunori | |
| 7,159,284 | B2 | 1/2007 | Gastaldi | |
| 7,888,572 | B2 | 2/2011 | Rosenberg et al. | |
| 2007/0107169 | A1 | 5/2007 | Kung | |

* cited by examiner

*Primary Examiner* — Robert J Sandy
*Assistant Examiner* — Michael Lee
(74) *Attorney, Agent, or Firm* — Whyte Hirschboeck Dudek S.C.

(57) ABSTRACT

A buckle for securing strap ends to each other has an anchor peg, with a recess, attached to one strap end. Another strap end has a clamping head that has a recess adapted to allow insertion and removal of the anchor peg. A moveable locking mechanism in the clamping head can be moved from an open position, that allows insertion or removal of the anchor peg, to a closed position that prevents removal of an anchor peg inserted into the clamping head.

5 Claims, 9 Drawing Sheets

BELT BUCKLE

CROSS-REFERENCE TO RELATED APPLICATION

This application claims the benefit of U.S. patent application Ser. No. 12/338,208, filed Dec. 18, 2008, which claims the benefit of U.S. provisional patent application No. 61/014,558 entitled "BELT BUCKLE" filed on Dec. 18, 2007, the entirety of which is hereby incorporated by reference herein.

FIELD OF THE INVENTION

This invention relates generally to the field of clasping mechanisms, and more specifically, to an apparatus and method for attaching two straps, or two ends of the same strap, to each other.

BACKGROUND OF THE INVENTION

Means for securing ends of straps together are well-known. Such means include, for example, buckles, clasps and the like. Although many of the known buckles function sufficiently, the industry is always looking for designs that are simple to use and aesthetically pleasing. One objective of this invention is to provide such a buckle.

SUMMARY OF THE INVENTION

In one embodiment, the invention is an apparatus for buckling straps. The apparatus comprises an anchor peg attached to a first strap. The anchor peg has a first end proximate to the strap and a second end distal from the strap. Also, the anchor peg has at least one recess located between the proximate and distal ends. Additionally, a clamping head is attached either to the first strap or to a second strap. The clamping head has an opening that is adapted to receive insertion of the distal end of the anchor peg into the clamping head. Also, a locking element is operationally connected to the clamping head, with the locking element being selectively moveable from a first position to a second position. When the locking element is in the first position, the anchor peg can freely be inserted and removed from the opening in the clamping head. Conversely, when the locking element is in the second position the locking element engages the recess of an anchor peg inserted into the opening of the clamping head to prevent removal of the distal end of the anchor peg from the opening in the clamping head.

In another embodiment, the invention provides a buckle assembly, comprising, in combination a clamping head, a locking element and an anchor peg. The clamping head has an opening adapted to receive the anchor peg therethrough and a magnet secured in a recess within the clamping head adjacent to the opening. The locking element and a ferrous material are attached to an end of a first strap. The anchor peg has a bore hole therethrough configured to removably receive the locking element. In embodiments, the clamping head and the anchor peg are attached to opposing ends of a second strap, and the first strap is attached to the second strap such that, with the anchor peg inserted through the opening of the clamping head, the locking element is insertable through the hole of the anchor peg and overlies the clamping head in a planar orientation. The ferrous material and the magnet cooperate together to releasably secure the locking element to the clamping head.

In another embodiment, the invention provides a buckle comprising a clamping head having a front plate, a back plate and a dial situated within an opening through the front plate and removably attached to the back plate, the dial being rotatable from a first position to a second position. The back plate has a through-hole adapted to receive an anchor peg therethrough, first and second spaced apart magnets secured to an inner surface of the back plate; and a moveable locking assembly comprising a locking element connected by an extension section to a pivotable arm, an attached ferrous material positioned between the two magnets, and the pivotable arm situated within a groove of the dial. When the dial is in the first position, the opening in the back plate is unobstructed by the locking element, and when the dial is in the second position, the opening is partially obstructed by the locking element. In addition, when the dial is in the first position, the ferrous material is in biased against the first magnet, and when the dial is in the second position, the ferrous material is biased against the second magnet. In embodiments, the buckle further comprises a pivotally moveable lever mounted on the inner surface of the back plate in communication with the pivotal arm. The buckle can be mounted on one end of a belt with an anchor peg attached to the other end of the belt. In use, the anchor peg is inserted through the opening in the back plate of the buckle and the locking element is forced into engagement with the recess of the anchor peg to secure the anchor peg within the buckle.

BRIEF DESCRIPTION OF THE DRAWINGS

Preferred embodiments of the invention are described below with reference to the following accompanying drawings, which are for illustrative purposes only. Throughout the following views, reference numerals will be used in the drawings, and the same reference numerals will be used throughout the several views and in the description to indicate same or like parts or steps.

DETAILED DESCRIPTION OF THE INVENTION

In the following detailed description, references made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical or shape changes may be made without departing from the spirit and scope of the present invention.

Figure 1:
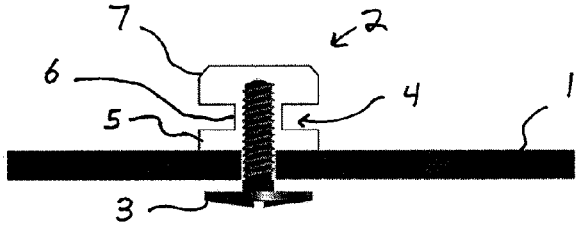
FIG. 1 shows a side view of an anchor peg mounted on a strap.

As shown in FIG. 1, an anchor peg 2 is attached to a strap 1. Strap 1 can be any suitable elongated piece, such as a belt. Although this invention is useable for attaching two straps together, or attaching one end of the strap to the other end of the strap, and the strap 1 need not be substantially flat as shown, for purposes of convenience, the invention will be described in the embodiment in which strap 1 is a belt that will be worn by a person with their clothing.

Anchor peg 2 is attached to strap 1 by any convenient means, such as screw 3 passing through a hole in strap 1 as shown. Anchor peg 2 has a proximate end 5 which is adjacent to or in contact with strap 1 and a distal end 7 which extends away from strap 1. A recess 4 is located on anchor peg 2 between the proximate end 5 and distal end 7. In the preferred embodiment shown, recess 4 is an annual groove such that anchor peg 2 has an approximately spool shape with an axle 6 between proximate end 5 and distal end 7. However, recess 4 can be of any suitable shape and configuration, such as slots, holes, notches, and the like.

In the preferred embodiment, FIGS. 2A-2F show front, back, and side views, respectively, of a sliding clamping head 8. Sliding clamping head 8 comprises a front component 9 and a back component 10. Back component 10 is attached to strap 1 through attachment means 13. Attachment means 13 can be any suitable mechanism such as a tooth clamp. Front component 9 slides back and forth in relation to back component 10. An opening 12 is provided in back component 10 for insertion of an anchor peg 2. A locking mechanism 11 is attached to front component 9. As shown, when front component 9 is in the open position (FIG. 2C), locking mechanism 11 is clear of opening 12 thereby allowing anchor peg 2 to be freely inserted and removed from clamping head 8. For convenience, back component 10 may be disassembled by removing retaining screw 14.

Figure 2A:
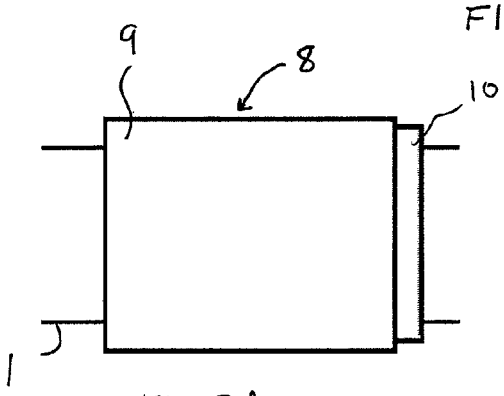
FIGS. 2A, 2C and 2E show front, back and side views of a buckle of the invention in open positions, respectively.
Figure 2B:
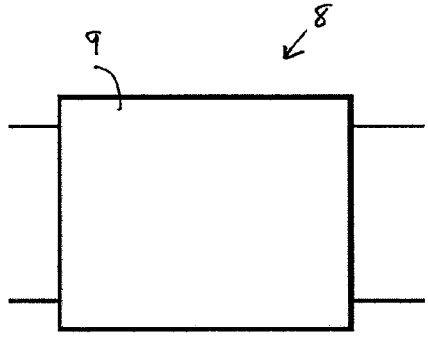
FIGS. 2B, 2D and 2F show front, back and side views of a buckle of the invention in closed positions, respectively.
Figure 2C:
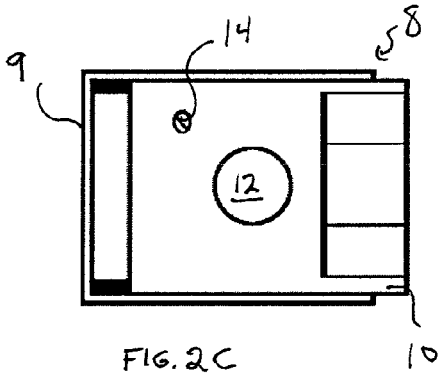
Figure 2D:
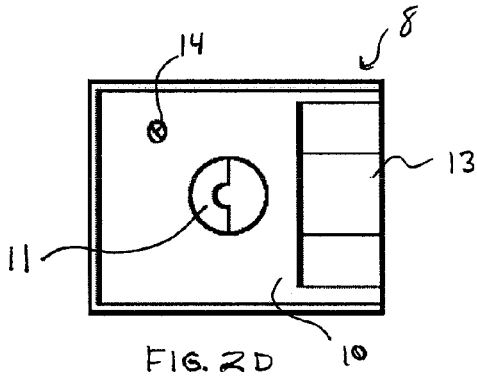
Figure 2E:
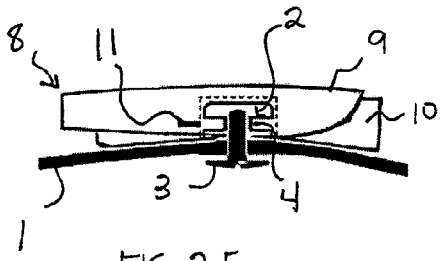
Figure 2F:
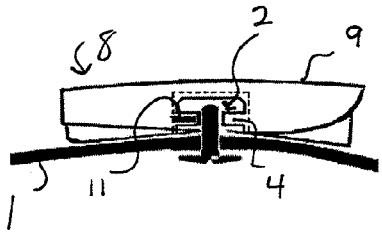

Views 2B, 2D and 2F show front, back, and side views of the sliding clamping head 8 when in the closed position. When sliding clamping head 8 is in the closed position, locking mechanism 11 extends into opening 12. The extension of locking mechanism 11 into opening 12 prevents the insertion or removal of an anchor peg 2. Particularly as seen in FIG. 2F, when an anchor peg 2 is inserted into opening 12 and the front component 9 is moved into a closed position, locking mechanism 11 moves into locking engagement with recess 4 in anchor peg 2. This locking engagement prevents removal of anchor peg 2 from opening 12 thereby securing sliding clamping head 8 to the end of the strap 1 where anchor peg 2 is located. As described in other embodiments, a biasing means, such as a spring or a magnet, or a combination of both may be provided to force locking mechanism 11 against an edge of recess 4 thereby providing a more secure locking engagement.

Figure 3A:
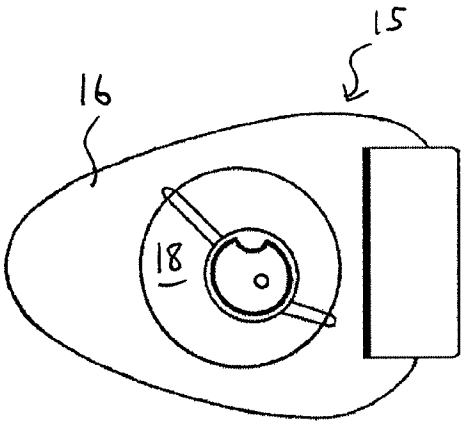
FIGS. 3A and 3B show front and back views of a second embodiment of the buckle of this invention in open positions, respectively.
Figure 3B:
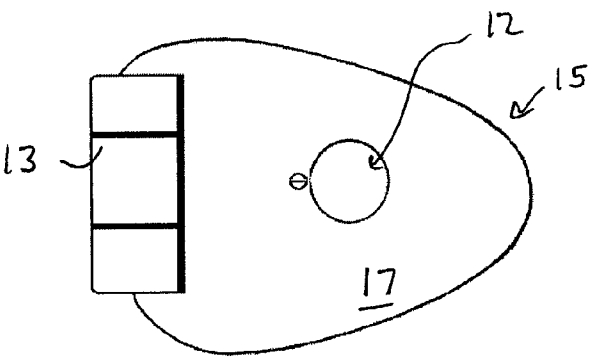
Figure 3C:
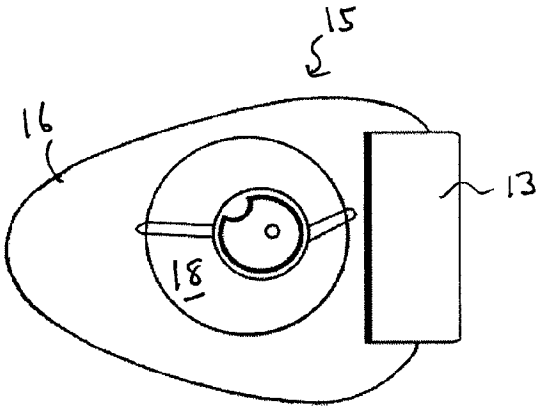
FIGS. 3C and 3D show front and back views of a second embodiment of the buckle of this invention in closed positions, respectively.
Figure 3D:
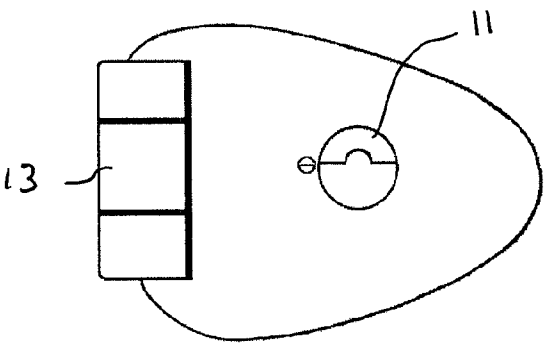

In another preferred embodiment, as shown in FIGS. 3A-3D, the locking mechanism rotates into position instead of sliding linearly into position. As shown in FIGS. 3A and 3B, rotational lock clamping head 15 comprises a front component and back component 16 and 17, respectively. A rotatable dial 18 is mounted on front component 16. Dial 18 is connected with locking mechanism 11 (FIG. 3D). Back component 17 has an opening 12 as described previously. When the locking mechanism is in the locking position, opening 12 is unobstructed allowing free insertion and removal of an anchor peg 2. As shown in views C and D, when dial 18 is moved to the closed position, locking mechanism 11 moves to partially obstruct opening 12. As described in the previous embodiment, this obstruction allows locking mechanism 11 to enter into locking engagement with recess 4 of anchor peg 2.

Figure 4A:
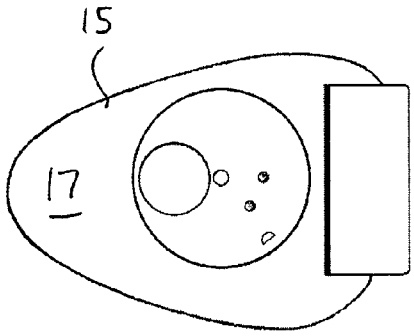
FIG. 4A shows a front view of the second embodiment of this invention with the sliding mechanism removed.
Figure 4B:
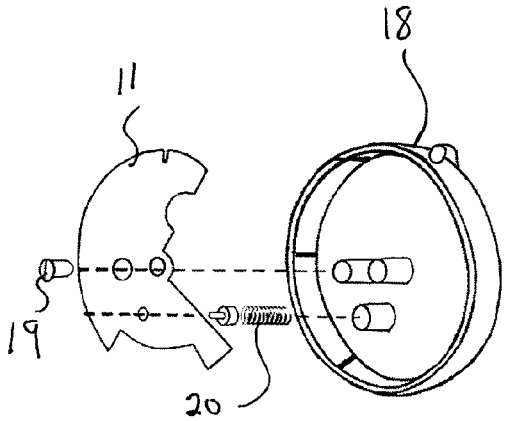
FIG. 4B shows an exploded view of the slide mechanism of the second embodiment of this invention.
Figure 5A:
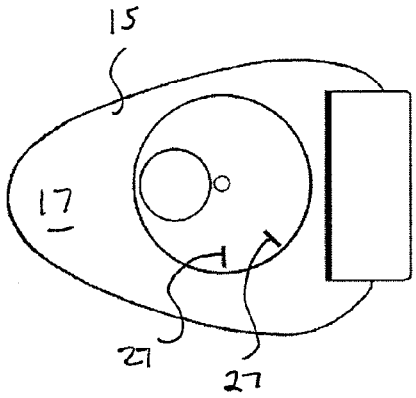
FIG. 5A shows a front view of the third embodiment of this invention with the sliding mechanism removed.
Figure 5B:
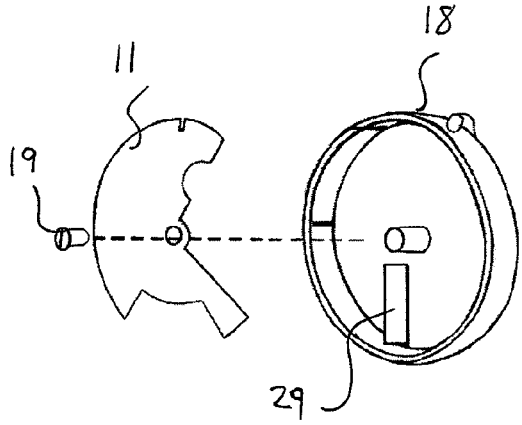
FIG. 5B shows an exploded view of the slide mechanism of the third embodiment of this invention.

FIG. 4A shows a front view of the rotating lock clamping head 15 with dial 18 and the locking mechanism 11 removed. FIG. 4B shows an exploded view of dial 18 and locking mechanism 11. As shown, locking mechanism 11 is secured to dial 18 by any simple means such as the securing screw 19 shown. Additional pegs or notches may be provided on dial 18 and/or locking mechanism 11 to further secure locking mechanism 11 in the desired orientation respective to dial 18. Also, a biasing means 20, such as a spring, may be installed between dial 18 and locking mechanism 11. The biasing means 20 forces the locking mechanism 11 into contact with an edge of recess 4 of anchor peg 2. In an alternate embodiment of the invention, as shown in FIGS. 5A and 5B, the biasing means 20 can be one or more magnets 27, wherein a ferrous material, for example steel, is secured to the dial 18 for securing one of the magnets 27.

Figure 6A:
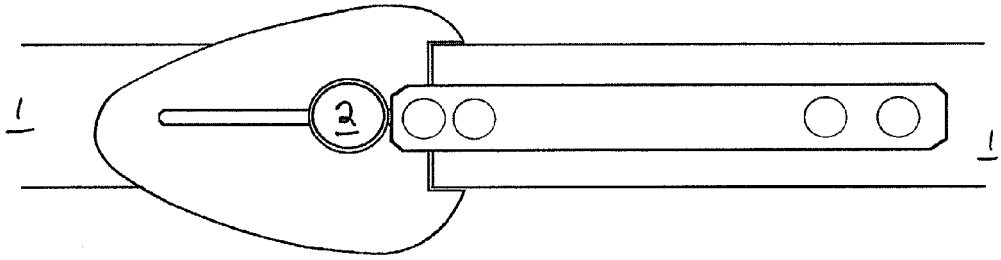
FIGS. 6A and 6B show top and side views, respectively, of a fourth embodiment of the buckle of this invention in the closed position.
Figure 6B:
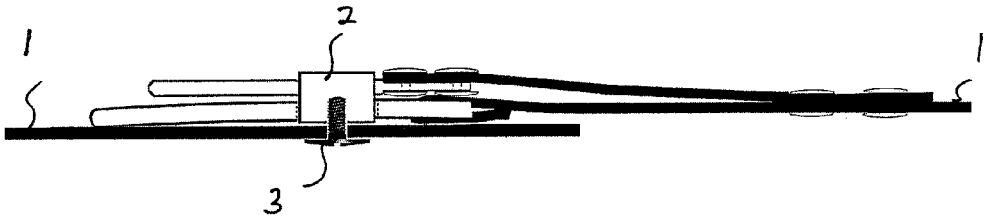
Figure 7A:
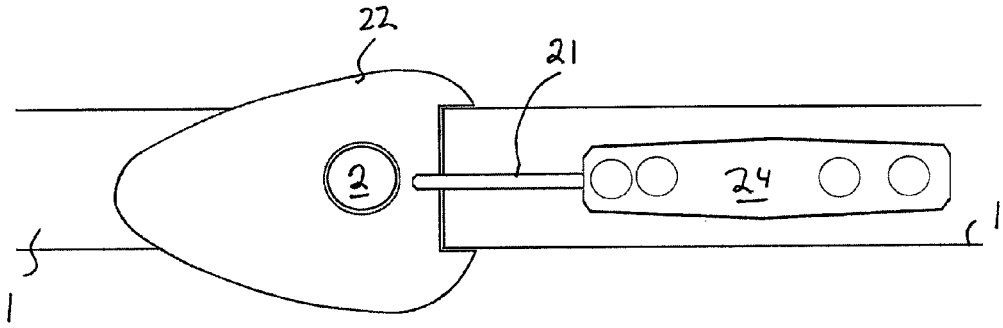
FIGS. 7A and 7B show front and side views, respectively, of the fourth embodiment of this invention in open position.
Figure 7B:
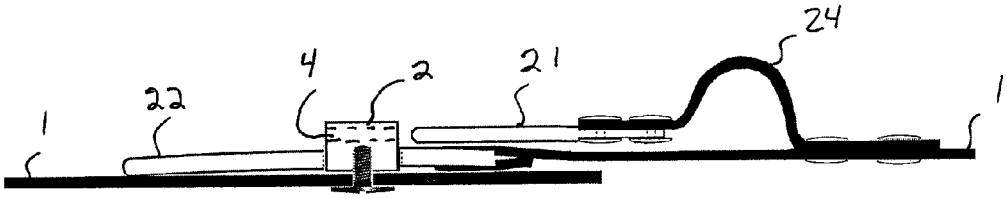
Figure 8:
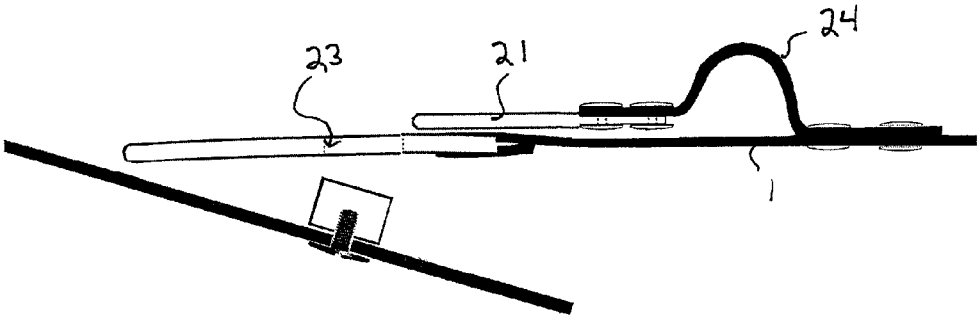
FIG. 8 shows a side view of the fourth embodiment of this invention with the anchor pulled away from the clamping head.

A fourth preferred embodiment of this invention is shown in FIGS. 6-8. Referring to FIGS. 6A and 6B, an anchor peg 2 is affixed to a strap 1 by suitable means such as screw 3. As shown in FIGS. 7A and 7B, recess 4 is a hole bored through anchor peg 2 and allows for insertion of locking element 21. As shown in FIG. 8, anchor peg 2 is adapted to fit through an opening 23 of clamping head 22. When locking mechanism 21 is inserted through the hole forming recess 4 in anchor peg 2, anchor peg 2 can no longer pass through opening 23 in clamping head 22. A flexible connector 24 connects locking mechanism 21 to strap 1 on the same end of the strap as clamping head 22. Flexible connector 24 may be any suitable device, but as shown here is a smaller strap of leather. In the relaxed position, flexible connector 24 is fully extended as shown in FIG. 6.

Referring now to FIG. 7, flexible connector 24 is bent, thereby withdrawing locking mechanism 21 from recess 4 in anchor peg 2. Disengaging locking mechanism 21 from anchor peg 2 allows anchor peg 2 to be disengaged from clamping head 22. Such disengagement is further illustrated in FIG. 8. Another embodiment of a belt buckle shown in FIGS. 6-8 is illustrated in FIGS. 9A-9G. Referring to FIGS.

9A and 9D, an anchor peg 2' is affixed to a strap 1' by a screw 3' or other suitable means. The anchor peg 2' is sized and adapted to fit through an opening 23' of clamping head 22'. The anchor peg 2' includes a recess 4', which is a hole bored therethrough, for insertion of a locking element 21', which is attached to a flexible connector 24' (e.g., leather strap) connected to the strip 1' adjacent the clamping head 22'. Similar to the embodiment shown in FIGS. 6-8, with the anchor peg 2' positioned in the opening 23' of the clamping head 22', insertion of the locking element through the recess 4' (i.e., bored hole) prevents the anchor peg 2' from being removed from the clamping head 22' of the buckle.

A fifth embodiment of a belt buckle is illustrated in FIGS. 9A-9G. Similar to the fourth embodiment shown in FIGS. 6-8, the buckle comprises a clamping head 22' having an opening 23' that is sized and adapted to receive an anchor peg 2' therethrough. In use, the clamping head 22' of the buckle is attached to one end of a strap 1' (e.g., belt) and the anchor peg 2' is affixed to the other end of the strap 1' by a screw 3' or other suitable means. The anchor peg 2' includes a recess 4', which is a hole bored therethrough, for insertion of a locking element 21', which is attached to a flexible connector 24' (e.g., leather strap) connected to the strap 1' adjacent the clamping head 22'. Similar to the fourth embodiment, with the anchor peg 2' positioned in the opening 23' of the clamping head 22', insertion of the locking element 21' through the recess 4' (i.e., bored hole) prevents the anchor peg 2' from being removed from the clamping head 22' of the buckle.

In the present embodiment, the buckle further comprises a magnet assembly 30' for securing the locking element 21' in position. The assembly 30' includes a magnet 31' situated in a recess 32' within the clamping head 22' adjacent to the opening 23'. As illustrated in an exploded view in FIG. 9E, the magnet 31' can be enclosed within the recess 32', for example, by a cover plate assembly 33*a*', 33*b*' which can be secured to the clamping head 22' by screws 34' or other suitable fastener.

A ferrous material 35' (e.g., steel) is secured to the end 36' of the flexible connector 24' proximal to the locking element 21'. When the locking element 21' is inserted through the recess 4' (bored hole) of the anchor peg 2', the attraction between the magnet 31' and the ferrous material 35' secures the locking element 21' in place and hinders its inadvertent withdrawal from the recess 4'. In embodiments, as illustrated, the ferrous material 35' can be provided as a fastener such as a threaded screw, for securing the locking element 21' to the flexible connector 24'.

Figure 9A:
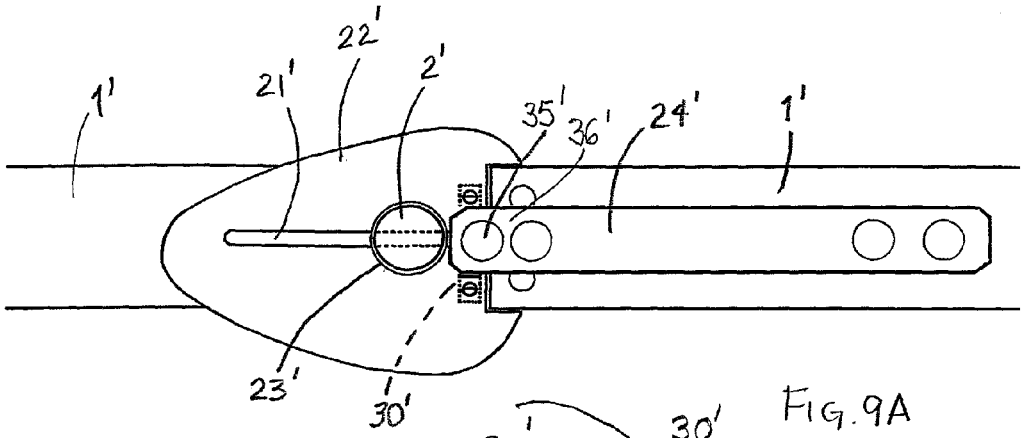
FIGS. 9A and 9B show front and side views, respectively, of a fifth embodiment of a belt buckle of the invention in the closed position.
Figure 9E:
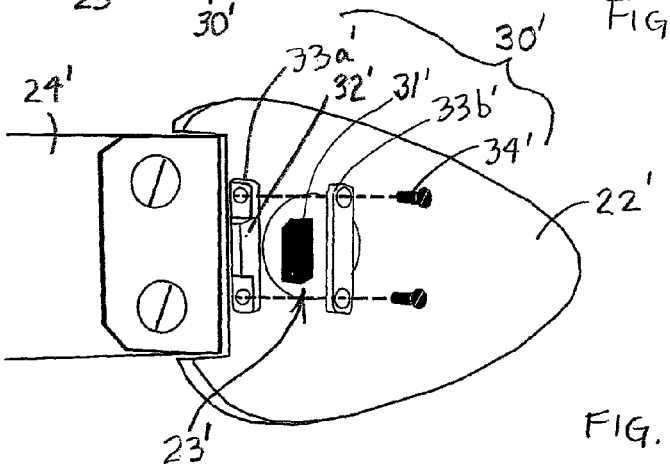
FIG. 9E shows the back side of the clamping head of the fifth embodiment of the belt buckle with an exploded view of the magnet assembly.
Figure 9B:
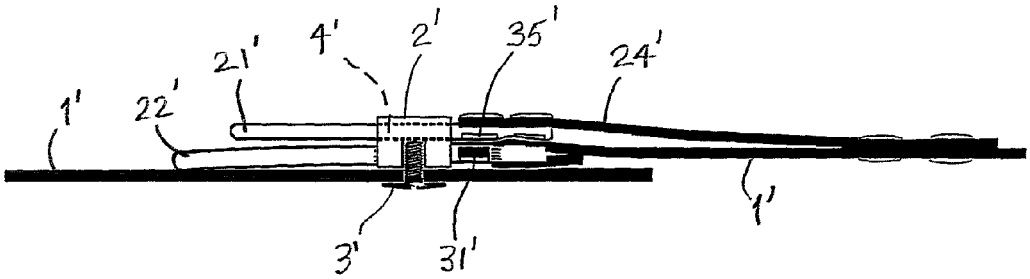
Figure 9C:
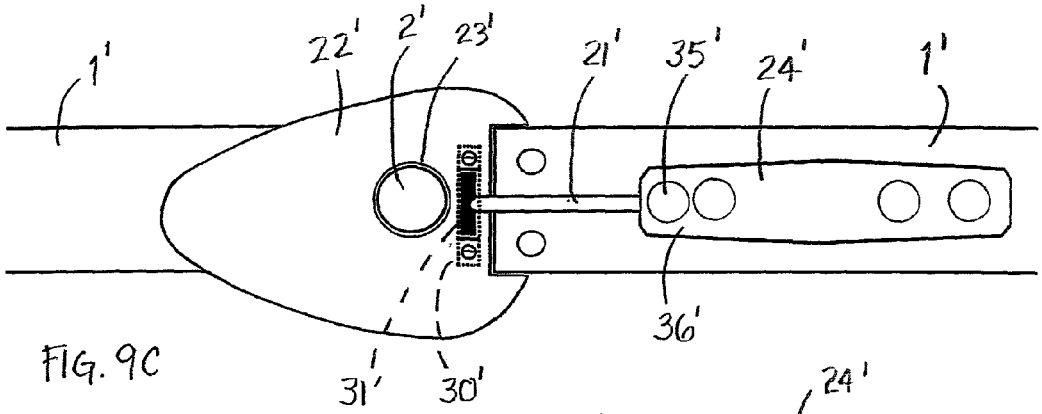
FIGS. 9C and 9D show front and side views, respectively, of the fifth embodiment of the buckle in an open position.
Figure 9D:
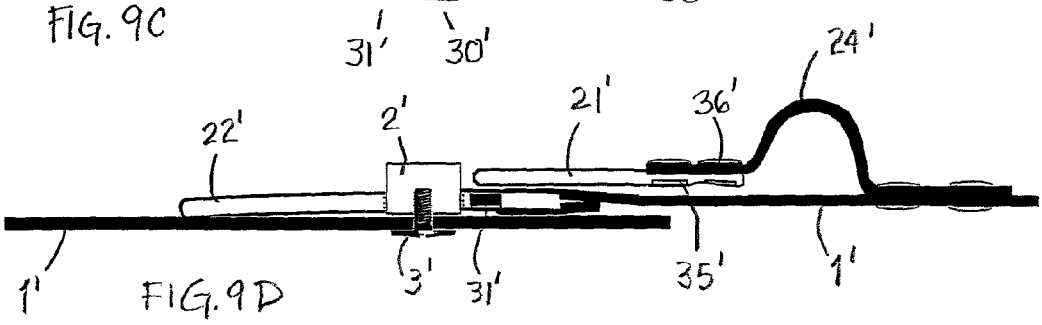
Figure 9F:
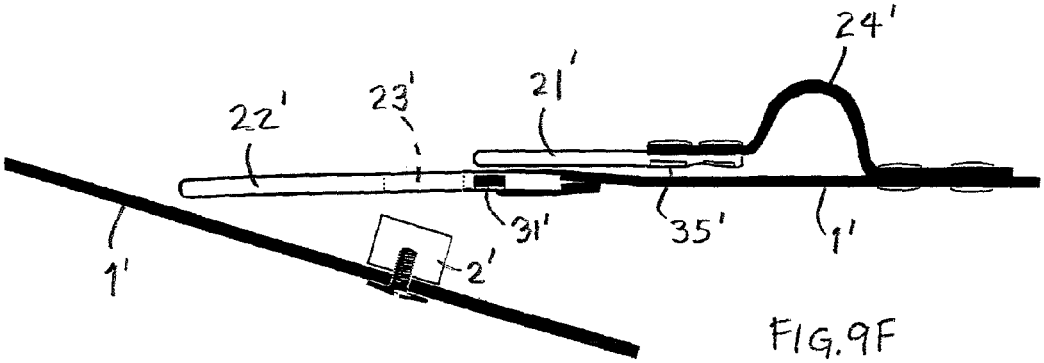
FIG. 9F shows a side view of the fifth embodiment with the anchor pulled away from the clamping head.

Referring now to FIG. 9D, the flexible connector 24' is drawn away from the anchor peg 2' to disengage the locking mechanism 21' from recess 4' within the anchor peg 2'. As illustrated in FIG. 9F, this allows the anchor peg 2' to be withdrawn from the opening 23' within the clamping head 22'.

A sixth embodiment of a belt buckle is illustrated in FIGS. 10A-10F. As shown, the buckle is structured with a locking clamping head 37 having a front component (plate) 38 and a back component (plate) 39. A rotatable dial 40 is mounted onto the front component 38 and interconnects to a slidable locking assembly 41.

The locking assembly 41 is composed of a locking element 42 which can be shifted from a first open/unlocked position (FIGS. 10A-10C) to a second closed/locked position (FIGS. 10D-10F) to lock and unlock an anchor peg 61 (FIGS. 11A-11B) within the opening 43 in the clamping head 37. As depicted in a cut-away view in FIGS. 10C and 10F with the front component 38 removed, the locking element 42 includes an extension 44 that is connected to an angled arm 45. In embodiments, the first end of the angled arm 45 can be structured with a protrusion 46 that is inserted into a through-hole at the distal end 47 of the extension 44.

The locking assembly 41 further includes a ferrous material 48 (e.g., steel plate) mounted on a bracket 49, which cooperates with two spaced apart magnets 50*a*, 50*b* mounted on the inside surface 51 of the back component 39 to force the locking element 42 into and out of engagement with the recess 62 of an anchor peg 61 (FIGS. 11A-11B) situated within the opening 43 of the clamping head 37.

A dam 52 mounted on the inside surface 51 of the back component 39 partially encircles the opening 43 opposite from the locking element 42. The dam 52 functions as a "back stop" against the side of the anchor peg 61 to facilitate engagement of the locking element 42 into the recess 62.

The rotatable dial 40 includes a grooved section 53 configured to receive the opposing end of the angled arm 45 therein. The rotatable dial 40 is mounted into an opening 54 through the front component 38 with the angled arm 45 situated within the grooved section 53.

Figure 10D:
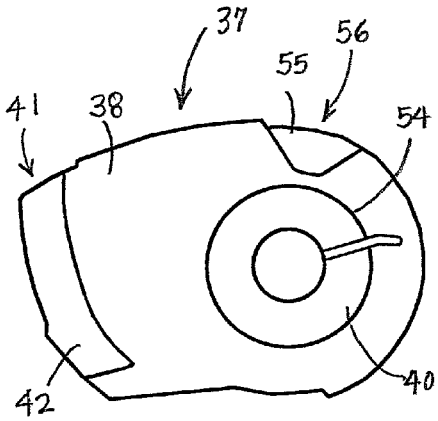
FIGS. 10D and 10E, respectively, show front and back views of the sixth embodiment in a closed position.
Figure 10A:
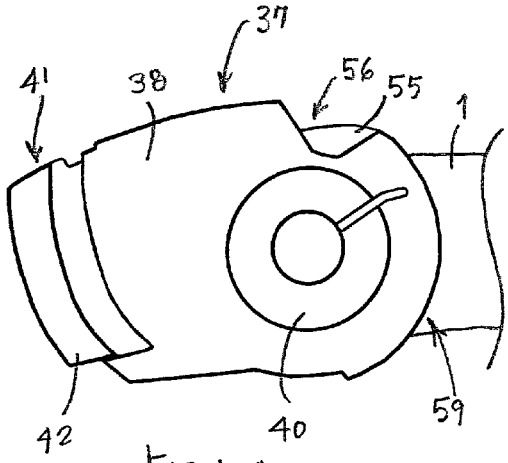
FIGS. 10A and 10B, respectively, show front and back views of a sixth embodiment of a buckle according to the invention in an open position.
Figure 10E:
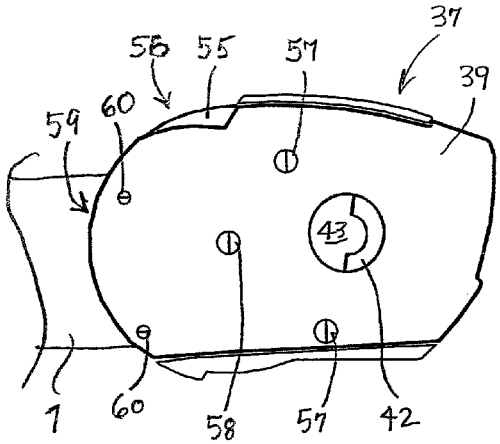
Figure 10B:
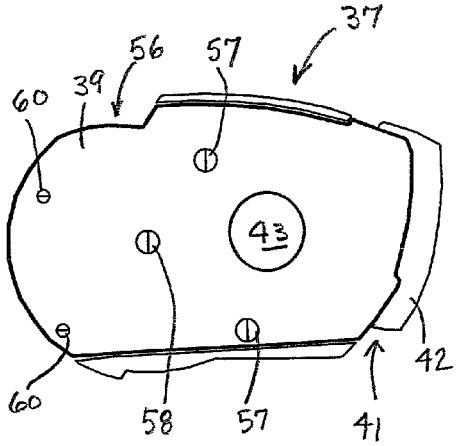
Figure 10F:
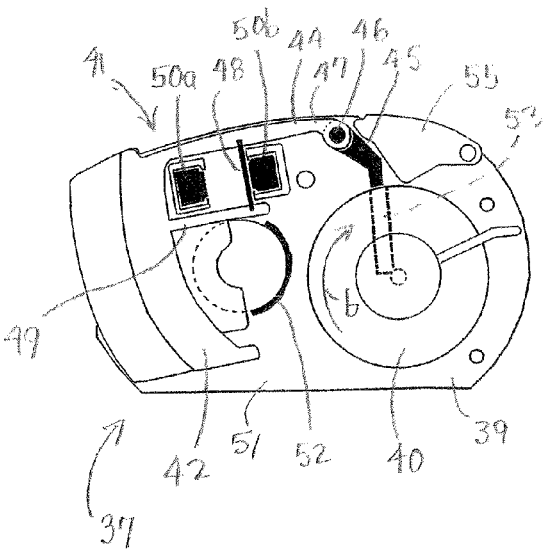
FIG. 10F illustrates the front view of the buckle in a closed position with the front component removed and the locking assembly exposed.
Figure 10C:
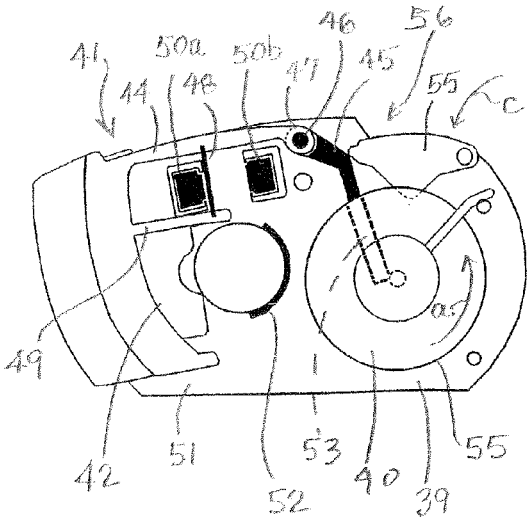
FIG. 10C illustrates the front view of the buckle in an open position with the front component removed and the locking assembly exposed.

Referring to FIG. 10C, when the dial 40 is rotated in the direction of arrow 'a', the angled arm 45 is pivoted which, in turn, forces the extension 44 and interconnected locking element 42 laterally outward and away from the opening 43 into open, unlocked position allowing the insertion and removal of an anchor peg 61.

Referring now to FIG. 10F, when the dial 40 is rotated in the direction of arrow "b", the angled arm 45 is again pivoted forcing the locking element 42 laterally inward toward the opening 43 into a closed or locking position to partially obstruct the opening 43 or engage the recess 62 of an anchor peg 61 which has been inserted into the opening 43, and lock the anchor peg in place.

The buckle further includes a lever 55, which is pivotally mounted on the inside surface 51 of the back component 39 and exposed through a gap 56 along the side of the clamping head 37. Referring to FIG. 10C, pressing the lever 55 (arrow 'c') exerts a force onto the angled arm 45 which, in turn, forces the extension 44 and interconnected locking element 42 in a lateral direction outward and away from the opening 43 (and the dial 40 to rotate). Rotating the dial 40 in the direction of arrow 'b' or forcing the locking element 42 laterally inward toward the opening 43 moves the locking element 42 into the opening 43.

Figures 11A, 11B:
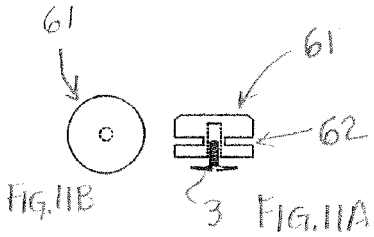
FIGS. 11A and 11B, respectively, show a side view and a top plan view of an anchor peg.

The front component 38 and the back component 39 can be secured together, for example, with screws 57 through the back component 39, and the rotatable dial 40 can be secured with screw 58, as shown in FIGS. 10B and 10E. As shown in FIGS. 10A and 10E, a strap 1 (e.g., belt) can be inserted into a gap 59 provided between the front and back components 38, 39, and secured to the buckle, for example, with screws 60.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A buckle, comprising:

a clamping head having a front plate, a back plate and a dial situated within an opening through the front plate and removably attached to the back plate, the dial being rotatable from a first position to a second position;

the back plate having a through-hole adapted to receive an anchor peg therethrough, first and second spaced apart magnets secured to an inner surface of the back plate; and a moveable locking assembly comprising a locking element connected by an extension section to a pivotable arm, an attached ferrous material positioned between the two magnets, and the pivotable arm situated within a groove of the dial;

wherein when the dial is in the first position, the opening in the back plate is unobstructed by the locking element, and when the dial is in the second position, the opening is partially obstructed by the locking element.

2. The buckle of claim 1, wherein when the dial is in the first position, the ferrous material is biased against the first magnet, and when the dial is in the second position, the ferrous material is biased against the second magnet.

3. The buckle of claim 1, further comprising a pivotally moveable lever mounted on the inner surface of the back plate in communication with the pivotal arm.

4. The buckle of claim 1, mounted on a belt having an anchor peg attached thereto.

5. The buckle of claim 4, wherein the anchor peg is situated within the opening in the back plate and the locking element is engaged in the recess of the anchor peg.

* * * * *